United States Patent [19]

Ishii et al.

[11] Patent Number: 4,997,180

[45] Date of Patent: Mar. 5, 1991

[54] SHEET FEEDER FOR USE IN SHEET-FED PRINTING PRESS

[75] Inventors: Koji Ishii; Naoki Ikeda, both of Fuchu, Japan

[73] Assignee: Ryobi Ltd., Fuchu, Japan

[21] Appl. No.: 336,359

[22] Filed: Apr. 11, 1989

[30] Foreign Application Priority Data

Apr. 11, 1988 [JP] Japan ..... 63-90141

[51] Int. Cl.[5] ..... B65H 29/54

[52] U.S. Cl. ..... 271/308; 271/82; 271/176

[58] Field of Search ..... 271/176, 314, 228, 307, 271/308, 312, 277, 82, 261

[56] References Cited

U.S. PATENT DOCUMENTS 3,046,009 7/1962 Hartel ..... 271/176

4,634,113 1/1987 Matsuda ..... 271/277

*Primary Examiner*—Richard A. Schacher

*Attorney, Agent, or Firm*—Sughrue, Mion, Zinn, Macpeak & Seas

[57] ABSTRACT

A sheet feeder in a sheet-fed printing press includes a detector 1 disposed adjacent to a feed portion of a paper feed or transfer cylinder 2 for detecting an improperly fed sheet of paper, and a gripper opening mechanism 6 actuatable for engaging a cam follower 13 to open a gripper 14 to release the improperly fed sheet of paper from the cylinder. A sheet discharge mechanism 16 has a sheet discharge roller 17 movable toward the cylinder for gripping therebetween the released sheet, and a stripper 18 movable toward the cylinder for stripping the improperly fed sheet and discharging it along a paper guide. An actuator 4.5 is connected to the detector for actuating the gripper opening mechanism and moving the sheet discharge roller and the stripper in response to the detection by the detector of the improperly fed sheet of paper.

26 Claims, 8 Drawing Sheets

SOLENOID
4a, 5a
RESET
RESET
PAPER THICKNESS SET COMPLETION ACKNOW. MEANS
VI
SET
PAPER SUPPLY ACKNOW. MEANS
V
REFERENCE VOLTAGE
II
COMPARISON MEANS
III
PAPER SUPPLY UNIT ACTIVATING MEANS
VIII
CIRCUIT ACTIVATING MEANS
IV
PAPER THICKNESS SETTING MEANS
I
COUNTER
CLOCK
PULSE GENERATING MEANS
VII
LIGHT EMITTING ELEMENT
109
LIGHT RECEIVING ELEMENT
110
E
127
126-5
126-4
126-n
125-n
125-5
125-4
125-3
125-2
125-1
126-1
126-2
126-3
121-n
121-5
121
121-1
121-2
121-3
121-4

CLOCK
CE
OP
S
R
Q
T1
a
110a
110
110b
5a
4a
134
131
136
129
128
137
124
123
118
116
117
113
114
115
127
112
119
120
121
122
125-n
126-n
125-4
125-3
125-2
125-1
125
126
126-1
142
109
111
138
139
140
109b
109a

SHEET FEEDER FOR USE IN SHEET-FED PRINTING PRESS

BACKGROUND OF THE INVENTION

The present invention relates to a sheet feeder for use in a sheet-fed printing press having a paper feed cylinder on the paper feed side of an impression cylinder, or a multi-chromatic sheet-fed printing press having a single transfer cylinder or a plurality of transfer cylinders between the impression cylinders of adjacent two printing units. More particularly, the invention relates to a device for detecting and discharging an improperly fed sheet or sheets of paper, such as two or more simultaneously fed sheets, a diagonally oriented irregular sheet, or a dirty sheet, supplied to the paper feed cylinder or the transfer cylinder or cylinders.

Sheet-fed printing presses are designed such that they are normally supplied with one sheet of paper at a time during their operation. When two or more sheets of paper are simultaneously supplied, however, one or more sheets of paper remained unprinted and are discharged. Furthermore, when such improperly fed sheet or sheets are transferred into the printing press, they tend to cause trouble, damaging the blankets of the cylinders or resulting in a paper jam. Repairing the damaged parts or removing the paper jam requires a large expenditure of time and labor.

There is known a sheet-fed printing press having a means for detecting two or more simultaneously fed sheets of paper and stopping the feed of such sheets of paper. After the feed of the sheets has been stopped, the improperly fed sheets have to be removed. In case an irregularly fed sheet of paper which may be oriented vertically or laterally, or a dirty sheet of paper, is supplied, an improperly printed sheet of paper comes out of the printing press, and is discharged into a paper discharge section where it is mixed with other properly printed sheets of paper. Therefore, the improperly printed sheet has to be subsequently removed from the paper discharge section for desired quality control. Since the removal of the improperly printed sheet is timeconsuming and laborious, the rate of printing sheets of paper on the printing press is low.

SUMMARY OF THE INVENTION

In view of the aforesaid problems of the conventional sheet feeders, it is an object of the present invention to provide a sheet feeder for use in a sheet-fed printing press, which has a means for detecting an improperly fed sheet or sheets of paper such as two simultaneously fed sheets, an irregular sheet, or a dirty sheet, to open grippers or a paper feed cylinder or a transfer cylinder, and for discharging out the improperly fed sheet or sheets without feeding them to the position between a blanket cylinder and an impression cylinder, so that the feed of sheets of paper will not be stopped, no parts repair and no paper jam removal will be needed, quality control will be carried out easily, and the efficiency of printing operation of the printing press will be increased.

According to the present invention, there is provided a sheet feeder in a sheet-fed printing press comprising:

a pair of frames provided in spaced apart relation with each other;

a paper supply cylinder rotatably supported between the pair of frames for supplying a sheet of paper into the sheed-fed printing press, the paper supply cylinder having a gripper shaft;

a gripper mounted on the gripper shaft, the gripper being selectively held in a closed state adapted to grip the sheet of paper between the paper supply cylinder and the gripper and in an open state adapted to release the sheet of paper gripped therebetween;

a detecting means disposed adjacent to the paper supply cylinder for detecting if the sheet of paper as supplied is proper or improper for performing a printing in the sheet-fed printing press;

a cam follower fixedly provided in the gripper shaft;

a gripper opening means disposed to be abuttable with the cam follower for causing the gripper to the open state;

a sheet discharge means for discharging the sheet of paper released when the gripper is in the open state; and an actuator means connected to the detecting means for abutting the gripper opening means with the cam follower and actuating the sheet discharge means to discharge the sheet of paper when the detecting means detects that the sheet of paper is improper.

The sheet discharge means comprises a sheet discharge roller for conveying the sheet of paper while being in surface contact with the paper supply cylinder, and a stripper disposed movably toward the paper supply cylinder for stripping the sheet of paper from the paper supply cylinder.

A printing sheet of paper is fed to the paper feed or transfer cylinder and then gripped by the gripper. When the sheet of paper is an improperly fed sheet, an irregular sheet, or a dirty sheet, it is detected by the detecting means, and the actuator means is operated in response to the detection to operate the gripper opening means. The gripper opening means engages the cam follower to open the gripper, thereby to release the gripped sheet of paper.

At the same time, the paper discharge means is operated to move the stripper and the sheet discharge roller toward the paper feed is now gripped and fed by the paper feed or transfer cylinder and the sheet discharge roller, then stripped from the cylinder by the stripper, and discharged along the paper guide onto discharge plates.

When the sheet of paper is properly fed to the paper feed or transfer cylinder, the detecting means is not operated, and the gripper opening means and the sheet discharge means are held in inactivated positions, and hence the stripper and the sheet discharge roller are spaced apart from the paper feed or transfer cylinder. Accordingly, the sheet of paper gripped by the gripper of the paper feed or transfer cylinder is fed between an impression cylinder and a blanket cylinder by which the sheet of paper is printed.

The above and other objects, features and advantages of the present invention will become more apparent from the following description when taken in conjunction with the accompanying drawings in which preferred embodiments of the present invention are shown by way of illustrative example.

DETAILED DESCRIPTION OF THE PREFERRED EMBODIMENTS

Figure 5:
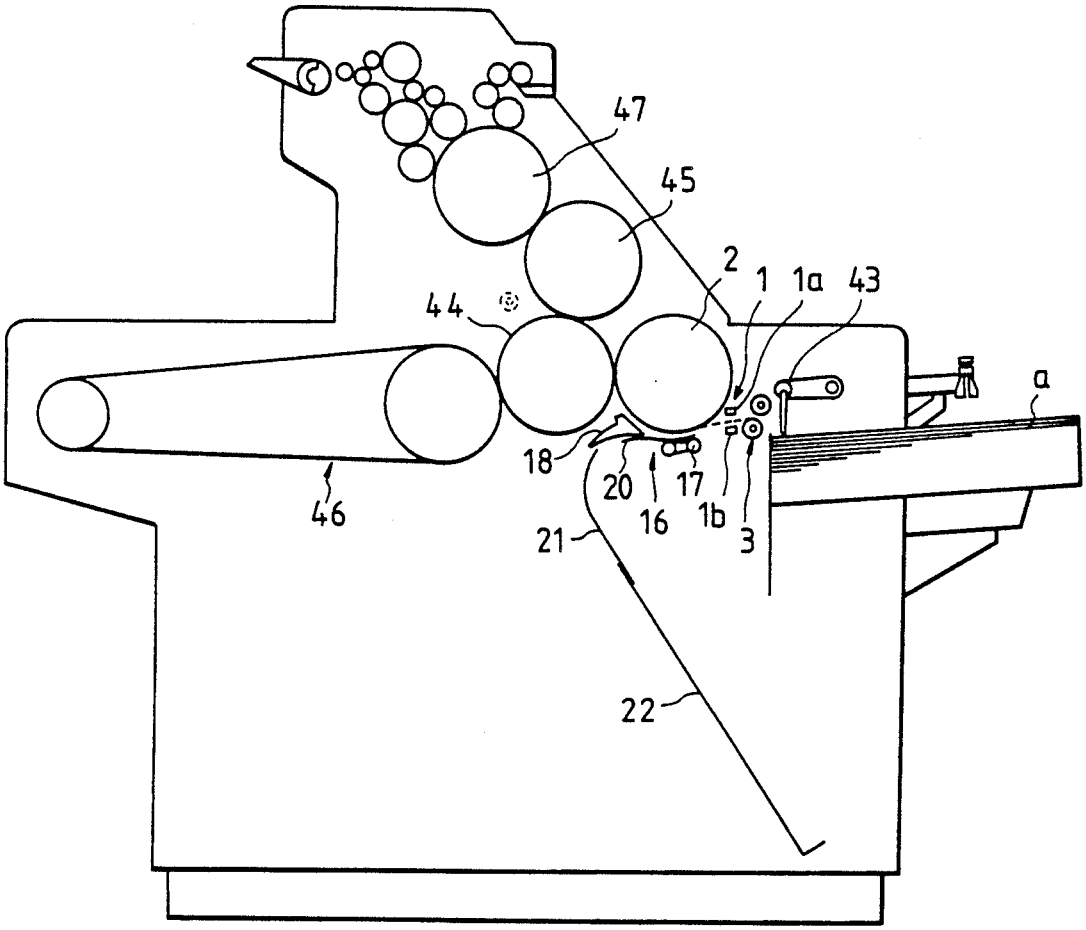
FIG. 5 is a schematic side elevational view of a monochromatic sheet-fed printing press having a paper feed cylinder, with the sheet feeder of the invention being incorporated in the printing press.

A sheet feeder for use in a sheet-fed printing press according to the present invention includes, as shown in FIG. 5, a detecting means 1 postioned near a paper feed portion of a paper feed cylinder 2, i.e., between the paper feed cylinder 2 and a feed roller 3.

The detecting means 1 comprises two sensor elements 1*a*, 1*b* for cooperatively detecting an improperly fed sheet or sheets of paper, a dirty sheet of paper, or the like. The detecting means 1 is an optical or magnetic sensor unit for detecting two or more simultaneously fed sheets of paper a based on the amount of light or magnetic flux that has passed through the sheets. Two pairs of sensor units are laterally positioned in spaced-apart relation for detecting a diagonally oriented sheet of paper. Such a sheet of paper can be detected if the two pairs of sensor units produce their respective outputs at different times. A dirty sheet of paper can be detected by detecting light reflected from a non-image area of the sheet of paper with the sensors 1*a*, 1*b* which in this case comprise optical sensors. The sensors 1*a*, 1*b* thus arranged can detect an improperly fed sheet or sheets, such as an diagonally oriented irregular sheet, a dirty sheet, or two or more simultaneously fed sheets, or the like. The detecting means 1 is not limited to the above-mentioned optical or magnetic sensor unit, but may comprise any other known sensor unit of the desired type.

Actuator means 4, 5 (FIG. 1) are electrically connected so as to be responsive to a signal from the detecting means 1, and comprise solenoids 4*a*, 4*b*, for example.

Figure 1:
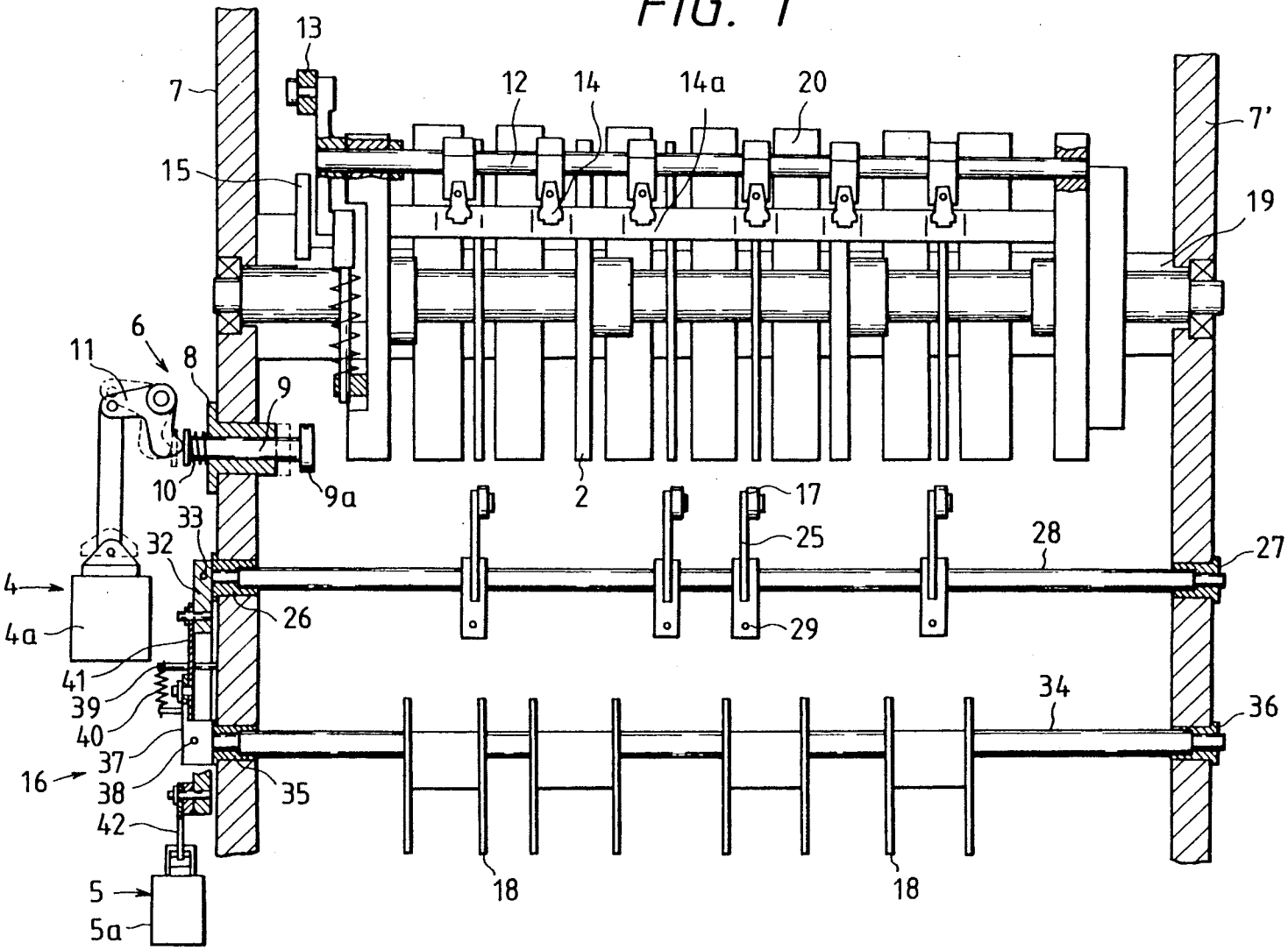
FIG. 1 is a sectional, developed plan view of a sheet feeder for use in a sheet-fed printing press according to an embodiment of the present invention.

As best shown in FIG. 1, a gripper opening means 6 comprises a pin 9 rotatably and axially (laterally) slidably supported in a printing press frame 7 through a bearing 8. The pin 9 is normally urged to project outwardly by a spring 10 disposed around an outer end of the pin 9. The pin 9 is operatively connected to the solenoid 4*a* of the actuator means 4 by a lever 11 pivotally mounted on the frame 7. When solenoid 4*a* is energized, the lever 11 causes the pin 9 to slide axially inwardly against the resiliency of the spring 10 until an inner end 9*a* of the pin 9 is brought into a position to engage a cam follower 13 on a gripper shaft 12. The pin 9 is arranged so as to project inwardly such that the cam follower 13 abuts against the pin 9 when grippers 14 and gripper bases 14*a* (described later) which grip a printing sheet of paper a are positioned between sheet discharge roller 17 and a stripper 18 (described later). When the solenoid 4*a* is de-energized, the pin 9 is axially moved outwardly under the bias of the spring 10 back to a position out of abutment against the cam follower 13.

More specifically, when the detecting means 1 detects an improperly fed sheet or sheets, the actuator means 4 is turned on to enable the lever 11 to push the pin 9 from the two-dot-and-dash-line position to the solid-line position (FIG. 1) in alignment with a cam 15 for abutting engagement with the cam follower 13 which is fixedly mounted on the gripper shaft 12 to open the gripper 14.

The gripper opening means 6 is not limited to the illustrated construction. The gripper opening means 6 may comprise a cam (not shown) fixed to an inner end of a shaft (not shown) rotatably mounted on the frame 7. Normally, the cam is retracted out of the path of the cam follower 13. When the detecting means 1 collects an improperly fed sheet, the solenoid 4*a* is energized to rotate the shaft about its own axis to position the cam on the path of the cam follower 13.

Figure 2:
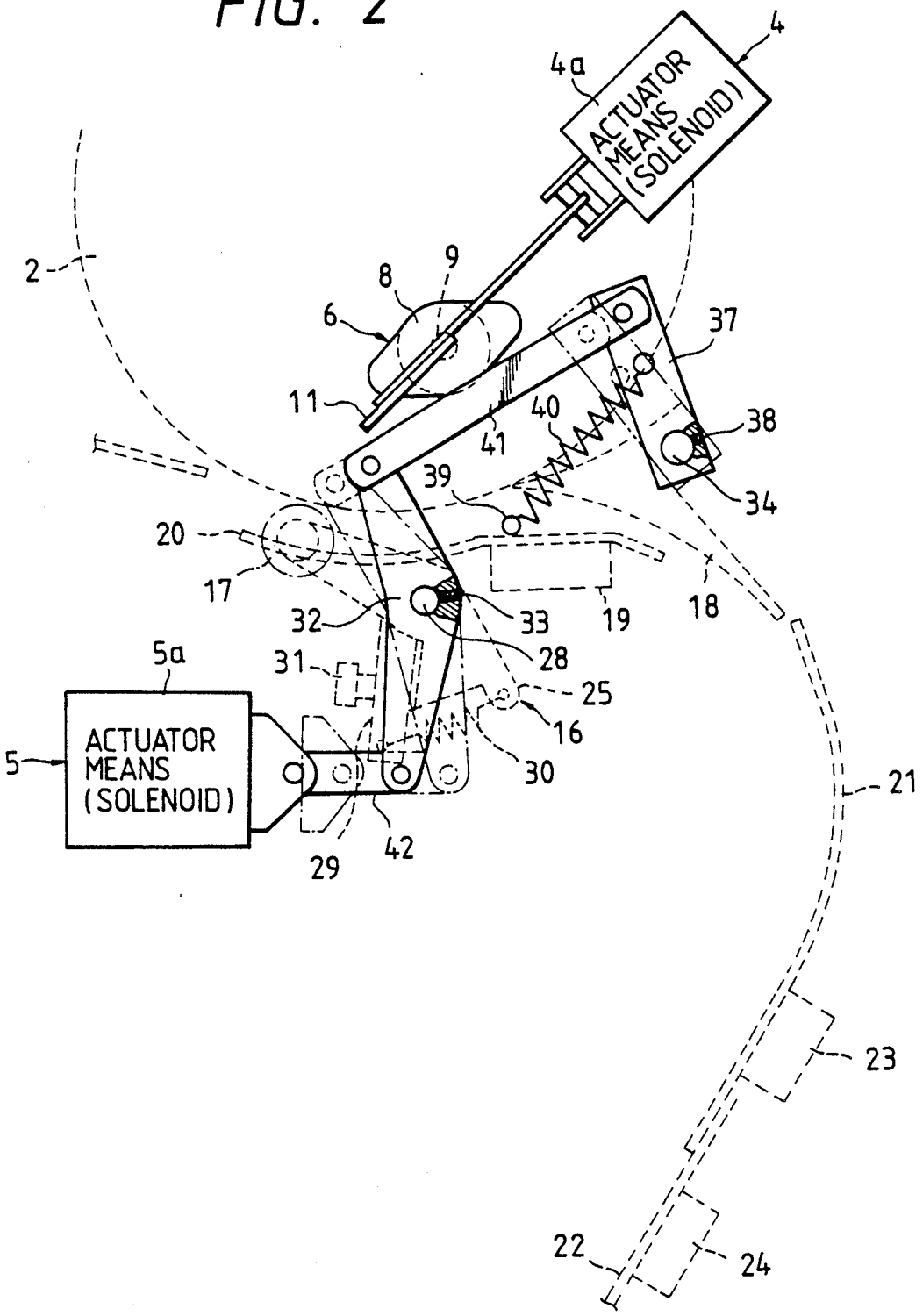
FIG. 2 is a lefthand side elevational view of the sheet feeder shown in FIG. 1.

As best shown in FIG. 2, a sheet discharge means 16 includes sheet discharge rollers 17 and stippers 18 which will be operated by the actuator means 5 in response to a signal from the detecting means 1. The sheet discharge means 16 is constructed as described below.

A plurality of paper guides 20 are fixedly mounted on a stay 19 supported on and extending between the frame 7 and another frame 7′ spaced from and lying parallel to the frame 7. Other paper guides 21 and sheet discharge plates 22 are fixedly mounted on stays 23, 24, respectively. The stays 23, 24 are supported on and extend between the frames 7, 7′, and extend substantially continuously from the rear ends of the paper guides 20.

As shown in FIG. 1, the sheet discharge rollers 17 are rotatably supported on the front ends, respectively, of roller arms 25. The roller arms 25 are fixedly supported on a roller shaft 28 rotatably supported on the frames 7, 7′ by means of bearings 26, 27, respectively, against axial movement. The roller arms 25 have rear ends connected by springs 30 to a plurality of holders 29 fixed to the roller shaft 28 for biasing the sheet discharge rollers 17 into resilient contact with the paper feed cylinder 2. Screws 31 are threaded respectively through the holders 29 and have tip ends held against one side of the rear ends of the roller arms 25. The screws 31 can be adjusted to hold the sheet discharge rollers 17 uniformly against the sheet of paper a and the paper feed cylinder 2.

As shown in FIG. 1, the roller shaft 28 has one end projecting outwardly from the frame 7, and an arm 32 is centrally secured to the projecting end of the roller shaft 28 by means of a set screw 33.

As shown in FIGS. 1 and 2, a stripper shaft 34 extends between and is rotatably, but axially immovably, supported on the frames 7, 7′ by means of bearings 35, 36 rearwardly and upwardly of the paper guides 20, with the strippers 18 being fixedly mounted on the stripper shaft 34. The stripper shaft 34 has one end projecting outwardly from the frame 7, and an arm 37 is fixed to the projecting end of the stripper shaft 34 by means of a set screw 38.

Figure 3:
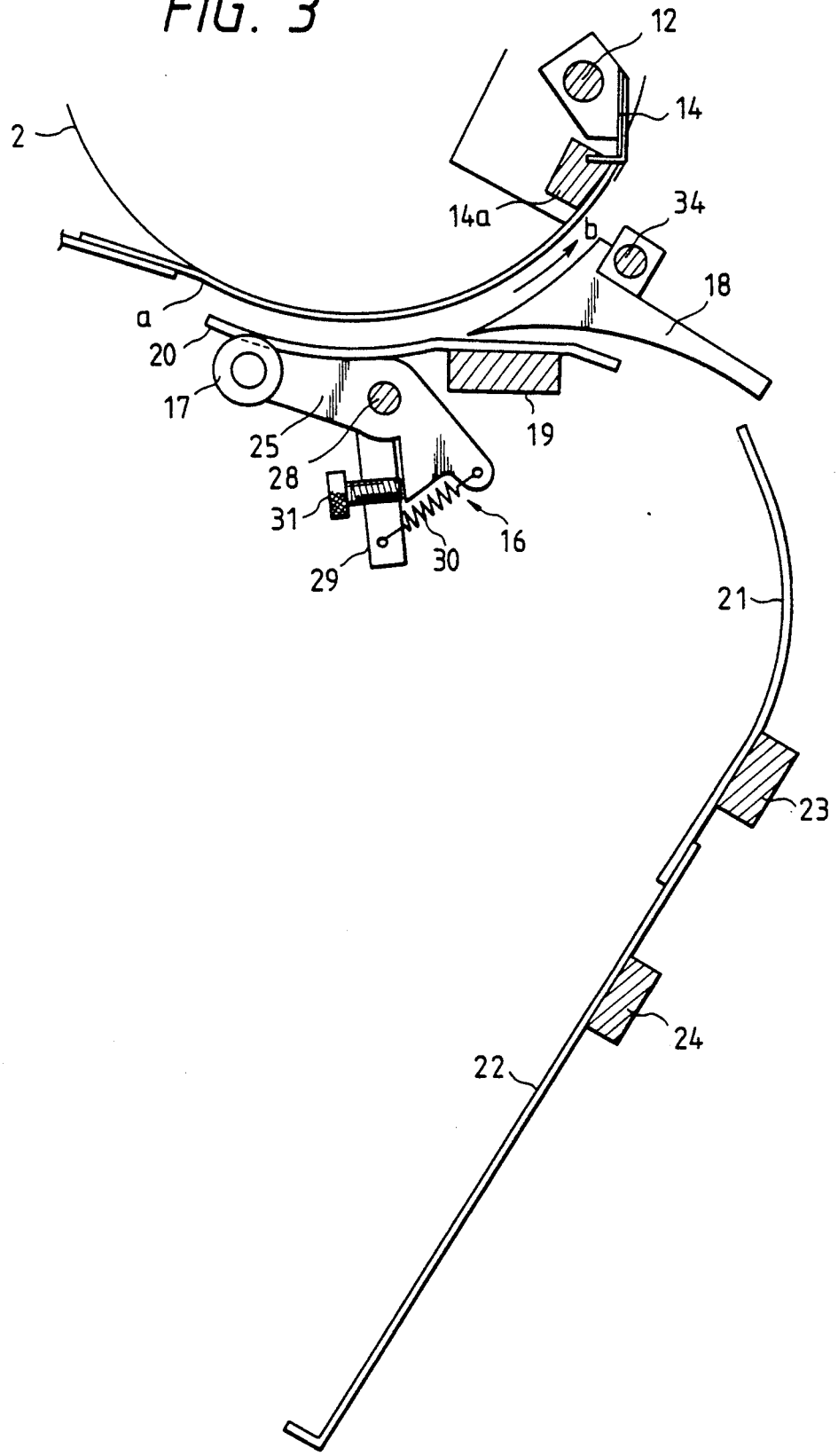
FIG. 3 is a sectional side elevational view showing the position of the parts when a sheet of paper is normally fed.

The arm 37 is normally urged by a spring 40 to rotate the strippers 18 from the position of FIG. 2 downwardly toward the position of FIG. 3, the spring 40 having one end engaging the arm 37 and the other end a spring retainer 39 on the frame 7.

The arms 32, 37 are operatively coupled to each other by means of a link 41 having one end connected to one end of the arm 32 and the other end to one end of the arm 37. The other end of the arm 32 is connected to the solenoid 5a of the actuator means 5 by means of an arm 42. Therefore, the roller shaft 28 and the stripper shaft 34 are angularly movable by a certain angle in response to energization and de-energization of the solenoid 5a.

Figure 4:
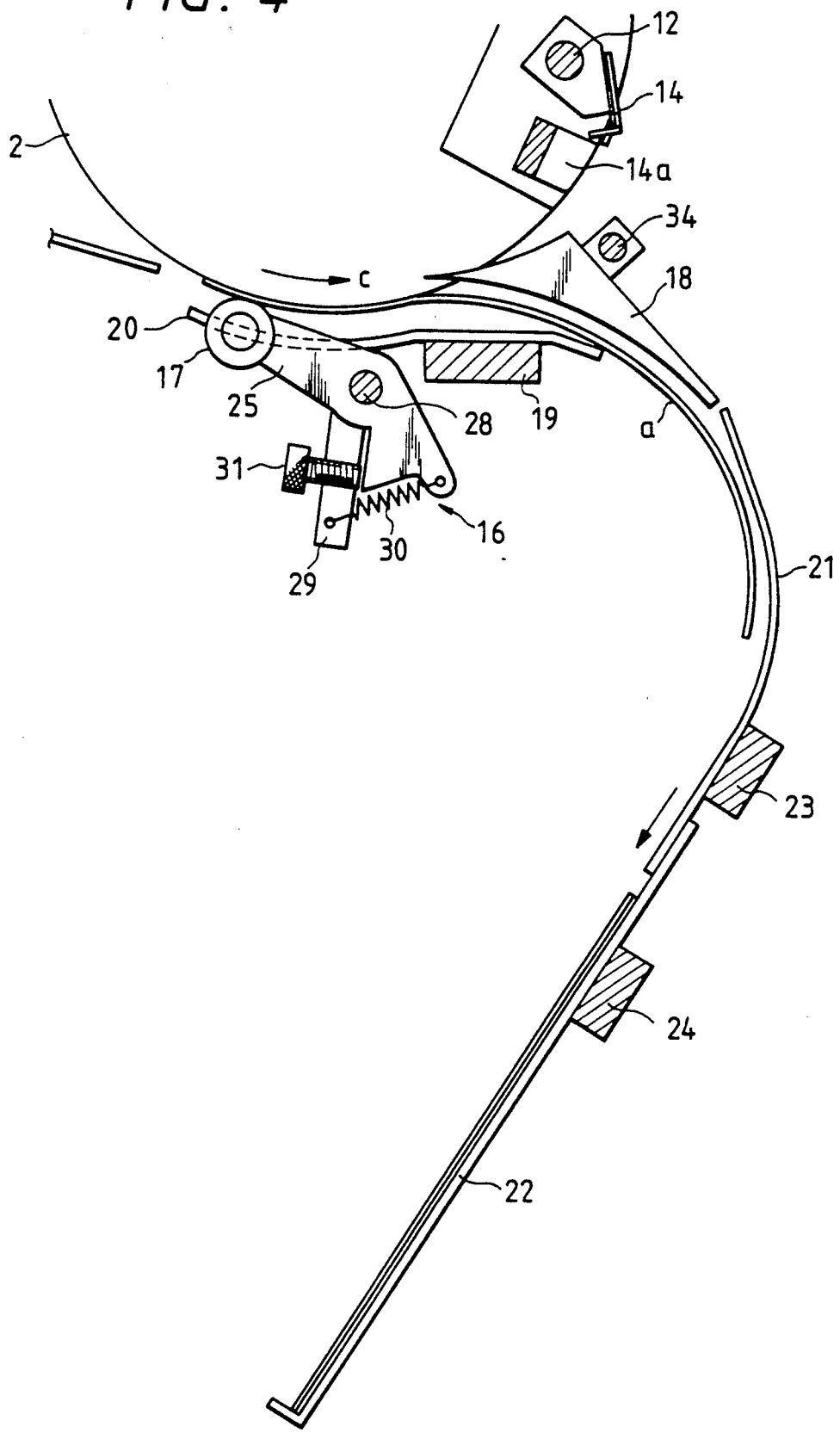
FIG. 4 is a sectional side elevational view illustrating the position of the parts when a sheet of paper is improperly fed.

When a sheet of paper a is properly fed, the paper discharge rollers 17 and the strippers 18 are held in respective positions spaced apart from the surface of the paper feed cylinder 2 as shown in FIG. 3, for allowing the sheet of paper a gripped by the grippers 14 and the grippper bases 14a of the paper feed cylinder 2 to be fed in the direction indicated by the arrow b. When the sheet of paper a is improperly fed, or an undesirable sheet of paper is fed, the detecting means 1 produces a signal to energize the solenoid 5a of the actuator means 5. The arms 32, 37, and the link 41 are angularly moved from the solid-line position to the two-dot-and-dash-line position in FIG. 2 to turn the paper discharge rollers 17 and the strippers 18 toward the paper feed cylinder 2 as shown in FIG. 4. The sheet of paper a is now gripped between the paper discharge roller 17 and the paper feed cylinder 2 and fed in the direction indicated by the arrow c, while at the same time the front ends of the strippers 18 strip the sheet a from the paper feed cylinder 2. The sheet a is now discharged along the paper guides 20, 21 onto the paper discharge plates 22.

When a sheet of paper a is properly fed after the improperly fed paper has been discharged, the detecting means 1 is turned off to de-energize the solenoids 4a, 5a, whereupon the gripper opening means 6 and the paper discharge means 16 return to their original positions as shown in FIG. 3.

In the illustrated embodiment, the actuator means 4, 5 responsive to the detecting means 1 comprise the respective solenoids 4a, 5a for operating the gripper opening means 6 and the paper discharge means 16, respectively. However, the gripper opening means 6 and the paper discharge means 16 may be operatively coupled to each other and actuated by a single actuator means, i.e., a single solenoid. Conversely, three solenoids may be provided for actuating the gripper opening means 6, the roller shaft 28, and the stripper shaft 34, respectively, of the paper discharge means 16.

In the above embodiment, the sheet feeder of the invention is incorporated in a monochromatic sheet-fed printing press having the paper feed cylinder 2 as shown in FIG. 5. In FIG. 5, a printing sheet of paper a is normally fed to the feed roller 3 by means of a suction foot 43. After the sheet a is fed to the paper feed cylinder 2 by the feed rollerr 3, the sheet a is gripped by the grippers 14 and the gripper bases 14a shown in FIGS. 1 through 4, and then transferred to paper grippers (not shown) on an impression cylinder 44 on which the sheet a is printed between the impression cylinder 44 and a blanket cylinder 45. Thereafter, the sheet a is transferred to paper grippers (not shown) on a chain delivery assembly 46 by which the sheet a is discharged. A plate cylinder 47 is held against the blanket cylinder 45.

Figure 6:
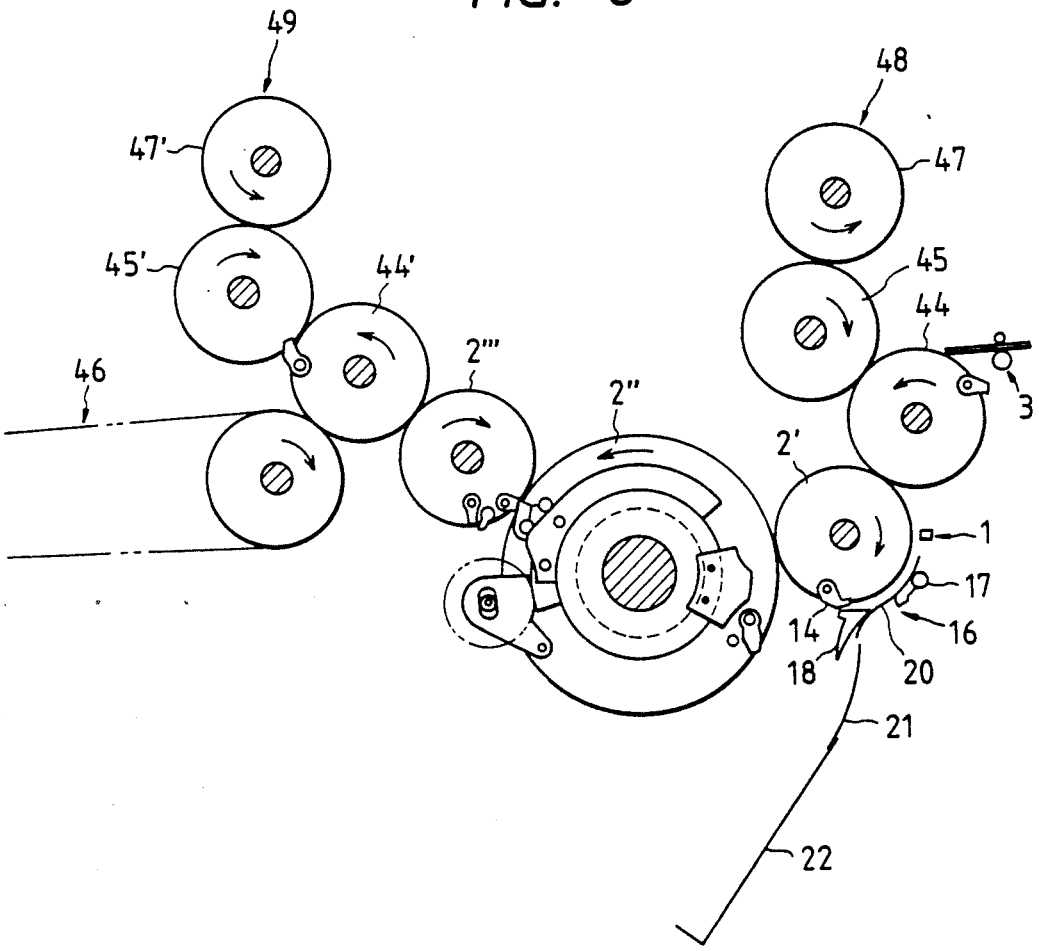
FIG. 6 is a schematic side elevational view of a dichromatic sheet-fed printing press having a paper transfer cylinder, with the sheet feeder of the invention being incorporated in the printing press.

FIG. 6 schematically shows a dichromatic sheet-fed printing press in which the sheet feeder of the invention is incorporated, the sheet feeder having the same structure as described above. The dichromatic sheet-fed printing press has transfer cylinders 2', 2'', 2''' for transferring a printing sheet a of paper from a first printing unit 48 to a second printing unit 49. The detecting means 1, the gripper opening means 6, and the paper discharge means 16 are associated with the transfer cylinder 2'. When a sheet of paper a printed by the first printing unit 48 is improperly fed to the second printing unit 49, it is detected and discharged in the same manner as described above with respect to the preceding embodiment. The second printing unit 49 includes an impression cylinder 44', a blanket cylinder 45', and a plate cylinder 47'.

Next, description will be made with respect to the detecting means 1 and its associated circuits. The detecting means 1 to be described hereinunder comprises a light emitting element 109 and a light receiving element 110. The light emitting element 109 emits a light and the light receiving element 110 is disposed in spaced apart relation with the light emitting element 109 to receive the light emitted from the light emitting element 109. A sheet of paper is passed through the space between the light emitting and light receiving elements 109 and 110. Due to simultaneously fed two or more sheets or a dirty sheet, if the amount of light received at the light receiving element 110 changes from an amount of light received thereat as a properly fed sheet passes through the space therebetween, the detection means 1 decides the sheet or sheets of paper passing therethrough as being improper.

Instead of the light emitting and the light receiving elements, the detection means 1 may comprise a magnetic flux producing unit for producing a magnetic flux and a magnetic flux sensing unit disposed in spaced apart relation with the magnetic flux producing unit to sense the magnetic flux from the magnetic flux producing unit. Likewise, the sheet of paper is passed through the space between the magnetic flux producing unit and the magnetic flux sensing unit. Due to simultaneously fed two or more sheets or a dirty sheet, if the amount of flux sensed in the magnetic flux sensing unit changes from an amount of magnetic flux sensed therein as a properly fed sheet passes through the space therebetween, the detection means 1 decides the sheet or the sheets of papers passing therethrough as being improper.

Figure 7:
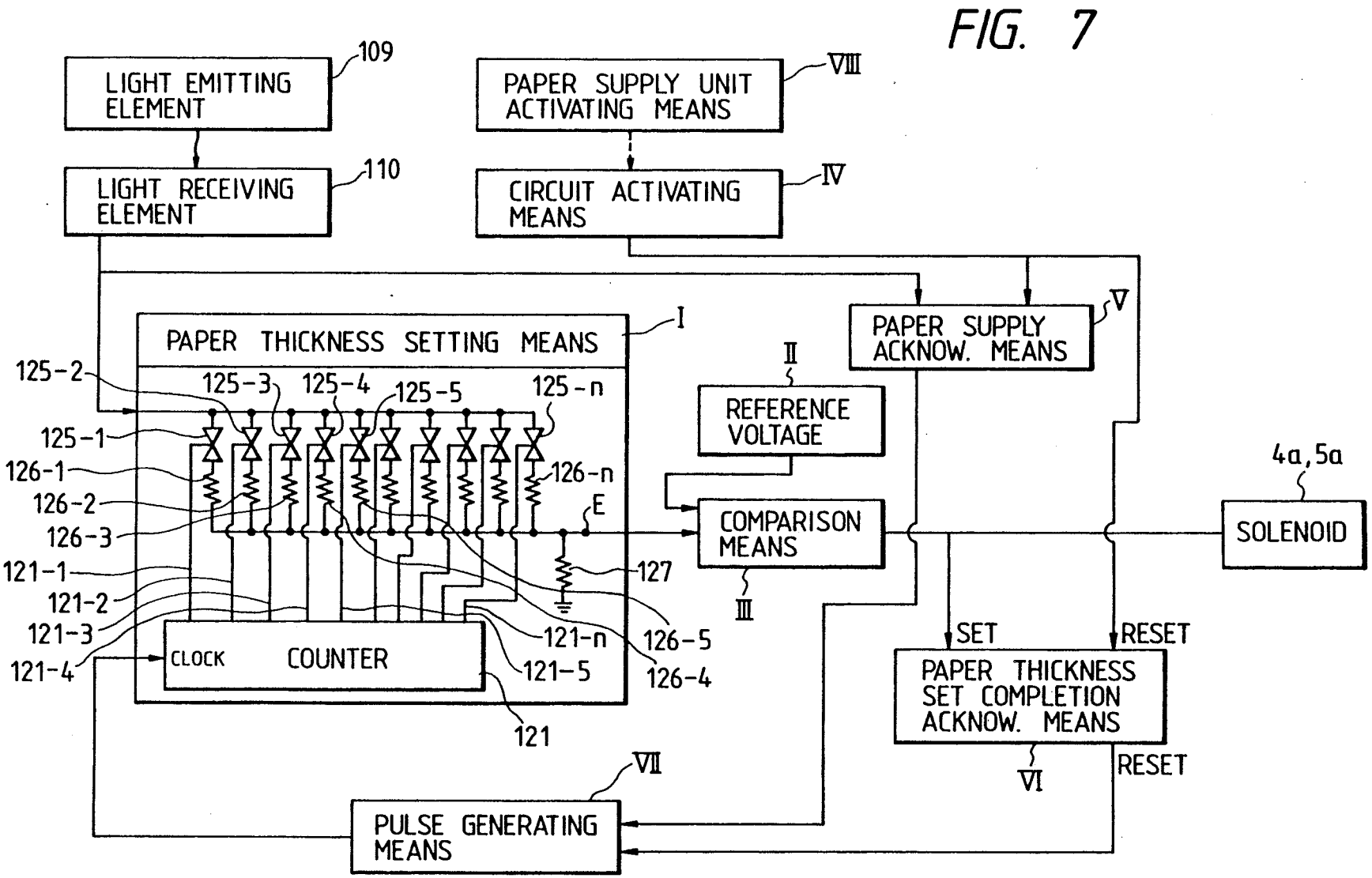
FIG. 7 is a block diagram showing a detecting means incorporated in the sheet feeder of the invention.
Figures 8, 9:
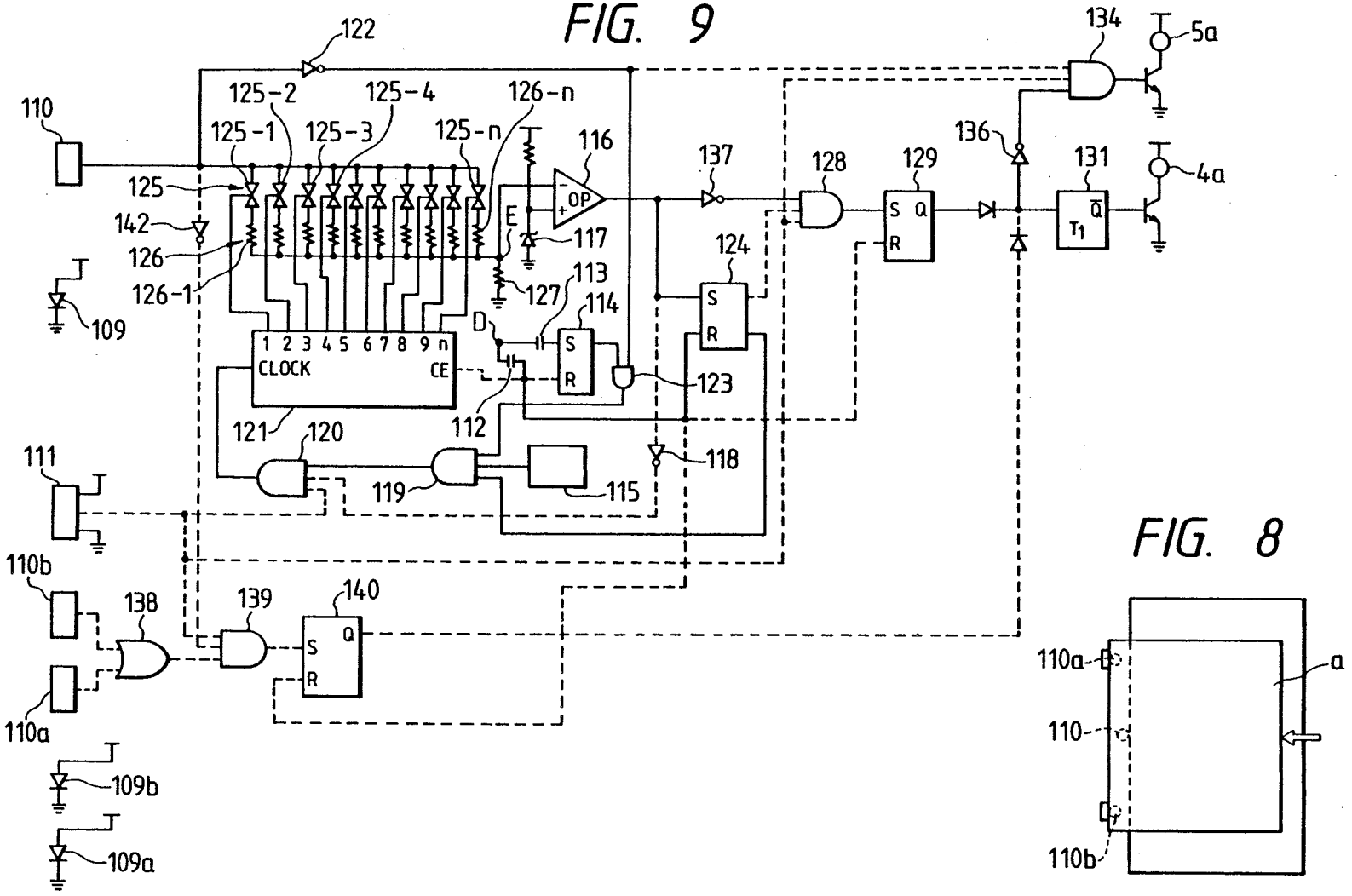
FIG. 8 is a planar schematic diagram showing the positions of the detecting means.
FIG. 9 is an electronic circuit diagram showing a detecting means incorporated in the sheet feeder of the invention.

Referring now to FIGS. 7 and 9, the light receiving element 110 outputs a voltage depending on the amount of light received from the light emitting element 109. The voltage outputted from the light receiving element 110 is applied to both a paper thickness setting means I and a paper supply acknowledging means V. The paper thickness setting means I includes a counter 121 which has n-number output terminals 121-1 through 121-n, n-number of normally closed contacts 125-1 through 125-n operatively connected in one-to-one correspondence to the n-number of the output terminals of the counter 121, n-number of resistors 126-1 through 126-n having one end connected in one-to-one correspondence to the respective one terminals of the contacts 125-1 through 125-n, and a resistor 127 having one end connected commonly to respective another ends of the n-number of resistors 126-1 through 126-n. Another end of the resistor 127 is connected to ground and another terminals of the n-number of contacts 125-1 through 125-n are connected to the output of the light receiving element 110. The n-number of resistors 126-1 through 126-n are set so as to be seequentially reduced in resistance values.

A pulse generating means VII comprises an oscillator 115 and an AND gate 119 as shown in FIG. 9. The output of the AND gate 119 is connected through and AND gate 120 to the clock terminal of the counter 121. The counter 127 outputs, for example, a high-level signal at one end of the output terminals in sequential fashion as it receives a clock pulse from the pulse generating means VII. In response to the high-level signal, the associated contact is closed. Therefore, each time the counter 121 receives a clock pulse, the contacts 125-1 through 125-n are sequentially closed one after another, so that a voltage developed across the resistor 127 changes depending on which contact is closed.

The output of the paper thickness setting means I, which is the voltage at a point E, is applied to one input terminal of a comparison means III. Another input terminal of the comparison means III is supplied with a reference voltage from a reference voltage setting means II which as shown in FIG. 9, comprises a Zenor diode 117 having an anode and a cathode connected to ground. The comparison means III comprises an operational amplifier 116 as shown in FIG. 9, which has an inverting input terminal connected to the point E and a non-inverting input terminal connected to the anode of the Zenor diode 127.

In the comparator III, the output voltage at point E is compared with the reference voltage. The comparator III outputs a de-energizing singal when the voltage at the point E is equal to or greater than the reference voltage and an energizing signal when the voltage at the point E is less than the reference voltage. The output from the comparator III is applied to the actuator means 4, 5 shown in FIG. 1 through an inverter 137, an AND gate 128, a flip-flop 129, an AND gate 134 and a timer 131. The deenergizing signal is, for example, produced when one of the contacts 125-1 through 125-4 is closed whereas the energizing signal is produced when one of the contacts 125-5 through 125-n is closed.

A circuit activating means IV is operatively coupled to a paper supply unit activating means VIII and causes a sheet thickness set completion acknowledging means VI to maintain at a reset condition to thereby allow the circuit to be operable.

The paper supply acknowledging means V comprises an AND gate 123, as shown in FIG. 9, and is operatively coupled to the circuit activating means IV. The paper supply acknowledging means V receives the activating signal from the circuit activating means IV and a paper supply detection signal from the light receiving element 110, and outputs a paper supply acknowledging signal to the pulse generating means VII. More specifically, when the suction foot 43 (see FIG. 6) is actuated and the output voltage from the light receiving element 110 is lowered due to the passing of the sheet of paper between the light emitting element 109 and the light receiving element 110, the paper supply acknowledging signal is produced from the paper supply acknowledging means V. It should be noted that as shown in FIG. 9, an inverter 122 is connected between the output of the light receiving element 110 and one input of the AND gate 123.

A paper thickness set completion acknowledging means VI comprises a flip-flop 124 as shown in FIG. 9 which is reset in response to the activating signal from the circuit activating means IV and is set in response to the de-energizing signal from the comparison means III or the output of the comparator 116. The means VI outputs a reset signal to the pulse generating means VII until the de-energizing signal is produced from the comparison means III.

The pulse generating means VII continuously generates clock pulses to the paper thickness setting means I when both the output signal from the paper supply acknowledging means V and the reset signal from the paper thickness set completion acknowledging means VI are received. More specifically, from the actuation of the suction foot 43 until the output of the de-energizing signal from the comparison means III, the clock pulses are generated from the clock pulse generating means VII to thereby cause the contacts 125-1 through 125-n to sequentially open one after another. It should be noted that all the contacts 125-1 through 125-n connected to the output terminals of the counter 121 are closed in sequence during a period of time from the actuation of the suction foot 43 to the transfer of the sheet of paper between the impression cylinder and the branket cylinder by means of a swing unit (not shown).

Referring to FIG. 10, the operation of the circuit thus arranged will be described. When the printing press is in operation, and the paper supply unit activating means VIII is actuated, a sheet of paper a is fed on a paper supply table. Simultaneously, a voltage higher than a circuit operating voltage is applied to an operation point D (see FIG. 9) which corresponds to the circuit activating means IV shown in FIG. 7, and the activation signal from the circuit activating means IV is applied through a capacitor 112 to the reset terminal of the flip-flip 124 of the paper thickness set completion acknowledging means VI to reset the same. The activation signal is further applied through a capacitor 113 and a flip-flop 114 to one input terminal of the AND gate 123.

When the sheet of paper a is in abutment with the front guide unit (not shown) and the light emitted from the light emitting element 109 is interrupted, then the output voltage from the light receiving element 110 falls down. This low-going output voltage from the light receiving element 110 is fed through the inverter 122 to one input terminal of the AND gate 123 of the paper supply acknowledging means V, so that a high-level signal is outputted therefrom to one input terminal of the AND gate 119 of the pulse generating means VII.

At this time, since the flip-flop 124 of the paper thickness set completion acknowledging means VI has been maintained at the reset condition and a reset status signal has been fed to the AND gate 119 of the pulse generating means VII. Therefore, the clock pulses generated from the oscillator 115 are allowed to be fed through the AND gate 120 to the clock input terminal of the counter 121. In response to the first clock pulse, the contact 125-1 connected to the output terminal 121-1 of the counter 121 is closed so that a voltage (e.g. 3.3 V) divided by the resistors 126-1 and 127 appears at the point E. However, this voltage (3.3 V) is below the reference voltage (e.g. 5 V), hence, the energizing signal is produced from the comparison means III. Since the papter thickness set completion acknowledging means VI has been remained at the reset condition, the second clock pulse is supplied to the clock input terminal of the counter 121. In response thereto, the contact 125-2 is in turn closed and a voltage (e.g. 3.8 V) divided by the resistors 126-2 and 127 appears at the point E. This voltage (3.8 V) is still below the reference voltage (5 V), the energizing signal is produced from the comparison means III. Similarly, the third and fourth clock pulses are suppled to the clock input terminals of the counter 121 and the contacts 125-3 and 125-4 are sequentially closed and voltages of, for example, 4.2 V and 4.5 V appear at the point of E. These two voltages are still below the reference voltage 5 V, so that the energizing signals are outputted from the comparison means III.

Next, when the fifth clock pulse is supplied to the clock input terminal of the counter 121 and the contact 125-5 is closed, a voltage (e.g. 5.3 V) appears at the point E. Since this voltage (5.3V) is above the reference voltage (5 V), the de-energizing signal is outputted from the comparison means III. In response thereto, the flip-flop 124 is set and the reset status signal is no longer applied to the AND gate 119. The generation of the clock pulses from the pulse generating means VII is thus halted. As a result, the contact 121-5 connected to the fifth output terminal 121-5 of the counter 12 remains at the opened condition.

In this condition, in response to the de-energizing signal from the operational amplifier 116, the solenoids 4*a*, 5*a* are de-energized, thereby allowing the sheet of paper fed into the printing press to be printed. Thus, the sheet of paper a firstly fed is transferred to the impression cylinder and fed between the nip between the impression cylinder and the banket cylinder. As shown, a proximity switch 111 may be provided in an appropriate position within the printing press to thereby detect the sheet of paper introduced into the printing press. The proximity switch 111 is provided so that the solenoids 4*a*, 5*a* may be energized only when the introduction of the sheet of paper into the printing press is acknowledged.

When a single sheet of paper is secondly fed in normal condition, the amount of light received at the light receiving element 110 is substantially the same as that received with respect to the firstly fed sheet of paper. The output voltage from the light receiving element 110 remains the same, say 10 V. Further, since the paper thickness set completion acknowledging means VI, i.e. flip-flop 124, has been maintained at set condition, the reset status signal is not fed to the AND gate 119. Accordingly, no clock pulses are fed to the counter 121. The output voltage from the light receiving element 110 is applied to the resistors 126-5 and 127 and the point E maintains the voltage 5.3 V. The comparison means III, i.e. operational amplifier 116, outputs the de-energizing signal and the the solenoids 4*a*, 5*a* in the actuator means 4, 5 are not energized as described. Thus, the secondly fed sheet of paper is fed into the nip between the impression cylinder and the bracket cylinder for printing. Insofar as a single and clean sheet of paper is fed onto the paper supply table in the normal condition, the similar operation is repeatedly carried out.

When two or more sheets of paper are improperly fed onto the paper supply table, the amount of light transmitted through the superposed sheets and received at the light receiving element 110 is reduced in comparison with the amount of light received through a single sheet of paper. The output voltage from the light receiving element 110 is accordingly reduced. Assuming that the output voltage from the light receiving element 110 is reduced to 8 V from 10 V, the voltage at the point E is dropped to 4.2 V (the resistance of the resistor 126-5 being assumed to be 4.5 Ohm and the resistance of the resistor 127 to be 5 Ohm). Since the voltage 4.2 V is below the reference voltage 5 V, the energizing signal is outputted from the comparison means III. In response to the energizing signal, the solenoids 4*a*, 5*a* of the actuator means are energized and the sheet of paper fed into the printing press is discharged out of the printing press as described hereinabove.

Referring to FIG. 8, there is shown another two light receiving elements 110*a* and 110*b* other than the light receiving element 110. The first light receiving element 110*a* is disposed in one side marginal position of the sheet of paper and the second light receiving element 110*b* is disposed in the opposite side marginal position thereof. More specifically, a line connecting these two side marginal positions is substantially perpendicular to a sheet supplying direction indicated by an arrow. The first and second light receiving elements 110*a* and 110*b* output first and second sheet presence signals, respectively, when said sheet of paper is detected. When the first and second sheet presence signals (low-level signals) are outputted at the same timing, it is decided that the sheet of paper passing along these two light receiving elements is properly fed. On the other hand, when the first and second sheet presence signals are outputted at different timings, it is decided that the sheet of paper passing therealong is diagonally oriented and thus improper. As shown in FIG. 9, first and second light emitting elements 109*a*, 109*b* are provided in association with the first and second light receiving elements 110*a*, 110*b*, respectively, in the same positional relationship described with respect to the light emitting and light receiving elements 109 and 110. Moreover, it can readily be apparent that a pair of a magnetic flux producing unit and a magnetic flux sensing unit can be employed for each of the light emitting and light receiving elements pairs 109*a*, 110*a* and 109*b*, 110*b*.

As shown in FIG. 9, the outputs of the light receiving elements 110*a*, 110*b* are connected to the inputs of an OR gate 138. The OR gate 138 causes to output another de-energizing signal only when the light receiving elements 110*a*, 110*b* sense the presence of the sheet of paper substantially simultaneously, thereby allowing the sheet of paper to be printed within the printing press. However, one of the two senses the presence of the sheet of paper at a timing earlier than the remainder or none of the two sense the sheet of paper, then another energizing signal is outputted to thereby energize the solenoids 4*a*, 5*a* of the actuator means 4, 5. Accordingly, by the provision of additional pairs of light emitting and light receiving elements, not only the superposed two or more sheets of paper or a dirty sheet of paper but also diagonally oriented sheet of paper can be detected and discharged out of the printing press.

In the circuit diagram shown in FIG. 9, the wire connections indicated by dotted lines are not requisite for accomplishing the intended operation but can be dispensed with if the a simplifed circuit configuration is preferred.

With the arrangement of the present invention, when an improperly fed sheet or sheets of paper such as two or more simultaneously fed sheets of paper, an irregular sheet of paper, a dirty sheet of paper, or the like is supplied, such a sheet or sheets are detected by the detecting means 1, and the gripper opening means 6 and the paper discharge means 16 are operated by the actuator means 4, 5 in response to a signal from the detecting means 1 to discharge the sheet or sheets out of the printing press from the paper feed cylinder 2 or the paper transfer cylinder 2'. Therefore, the problems of an unprinted sheet, a trouble caused by the feeding of a sheet to damage the blanket, a paper jam, removal of an improperly fed sheet or an improperly printed sheet, and the like are eliminated. An improperly fed sheet of paper can be discharged without shutting down the printing press or stopping the feed of sheets of paper. When a sheet of paper is properly fed, it is immediately supplied to the printing portion of the printing press for continued printing operation. Thus, the efficiency of printing operation is increased. Moreover, since no improperly printed sheets are discharged into the paper discharge section, quality control is facilitated.

Although certain preferred embodiments have been shown and described, it should be understood that many changes and modifications may be made therein without departing from the scope of the appended claims.

What is claimed is:

1. A sheet feeder in a sheet-fed printing press comprising:

a pair of frames (7,7') provided in spaced apart relation with each other;

a paper supply cylinder (2) rotatably supported between said pair of frames for supplying a sheet of paper into said sheet-fed printing press, said paper supply cylinder having a gripper shaft (12);

a gripper (14) mounted on said gripper shaft, said gripper being selectively held in a closed state adapted to grip said sheet of paper between said paper supply cylinder and said gripper and in an open state adapted to release said sheet of paper gripped therebetween;

a detecting means (1) disposed adjacent to said paper supply cylinder for detecting if said sheet of paper as supplied is proper or improper for performing a printing in said sheet-fed printing press;

a cam follower (13) fixedly provided on said gripper shaft;

a gripper opening means (6) disposed to be abuttable with said cam follower for causing said gripper to assume said open state;

a sheet discharge means (16) for discharging said sheet of paper released when said gripper is in said open state; and actuator means (4,5) connected to said detecting means for abutting said gripper opening means with said cam follower and actuating said sheet discharge means to discharge said sheet of paper when said detecting means detects that said sheet of paper is improper, whererin said detecting means comprises a light emitting element for emitting a light and a light receiving element disposed in spaced apart relation with said light emitting element to receive said light emitted from said light emitting element, said sheet of paper being passed through the space between said light emitting and light receiving elements, and wherein when an amount of light received at said light receiving element changes from an amount of light received thereat as said proper sheet of paper passes through said space, said detecting means decides said sheet of paper passing therethrough as being improper.

2. A sheet feeder according to claim 1, wherein said sheet discharge means comprises a sheet discharge roller (17) for conveying said sheet of paper while being in surface contact with said paper supply cylinder, and s stripper (18) disposed movably toward said paper supply cylinder for stripping said sheet of paper from said paper supply cylinder.

3. A sheet feeder according to claim 2, wherein said paper supply cylinder is a paper feed cylinder provided in a monochromatic sheet t-fed printing press having an impression cylinder and said paper feed cylinder.

4. A sheet feeder according to claim 2, wherein said paper supply cylinder is a paper feed cylinder provided in a multi-chromatic sheet-fed printing press having a plurality of printing units in succession, and said paper feed cylinder being provided between adjacent two printing units of said plurality of printing units.

5. A sheet feeder in a sheet-fed printing press comprising:

a pair of frames (7,7') provided in spaced apart relation with each other;

a paper supply cylinder (2) rotatably supported between said pair of frames for supplying a sheet of paper into said sheet-fed printing press, said paper supply cylinder having a gripper shaft (12);

a gripper (14) mounted on said gripper shaft, said gripper being selectively held in a closed state adapted to grip said sheet of paper between said paper supply cylinder and said gripper and in an open state adapted to release said sheet of paper gripped therebetween;

a detecting means (1) disposed adjacent to said paper supply cylinder for detecting if said sheet of paper as supplied is proper or improper for performing a printing in said sheet-fed printing press;

a cam follower (13) fixedly provided on said gripper shaft;

a gripper opening means (6) disposed to be abuttable with said cam follower for causing said gripper to assume said open state;

a sheet discharge means (16) for discharging said sheet of paper released when said gripper is in said open state; and actuator means (4,5) connected to said detecting means for abutting said gripper opening means with said cam follower and actuating said sheet discharge means to discharge said sheet of paper when said detecting means detects that said sheet of paper is improper, wherein said detecting means comprises a magnetic flux producing unit for producing a magnetic flux and a magnetic flux sensing unit disposed in spaced apart relation with said magnetic flux producing unit to sense said magnetic flux from said magnetic flux producing element, said sheet of paper being passed through the space between said magnetic flux producing unit and said magnetic flux sensing unit, and wherein when an amount of magnetic flux sensed in said magnetic flux sensing unit changes from an amount of magnetic flux sensed therein as said proper sheet of paper passes through said space, said detecting means decides said sheet of paper passing therethrough as being proper.

6. A sheet feeder according to claim 5, wherein said sheet discharge means comprises a sheet discharge roller for conveying said sheet of paper while being in surface contact with said paper supply cylinder, and a stripper disposed movably toward said paper supply cylinder for stripping said sheet of paper from said paper supply cylinder.

7. A sheet feeder in a sheet-fed printing press comprising:

a pair of frames (7,7') provided in spaced apart relation with each other;

a paper supply cylinder (2) rotatably supported between said pair of frames for supplying a sheet of paper into said sheet-fed printing press, said paper supply cylinder having a gripper shaft (12);

a gripper (14) mounted on said gripper shaft, said gripper being selectively held in a closed state adapted to grip said sheet of paper between said paper supply cylinder and said gripper and in an open state adapted to release said sheet of paper gripped therebetween;

a detecting means (1) disposed adjacent to said paper supply cylinder for detecting if said sheet of paper as supplied is proper or improper for performing a printing in said sheet-fed printing press;

a cam follower (13) fixedly provided on said gripper shaft;

a gripper opening means (6) disposed to be abuttable with said cam follower for causing said gripper to assume said open state;

a sheet discharge means (16) for discharging said sheet of paper released when said gripper is in said open state; and actuator means (4,5) connected to said detecting means for abutting said gripper opening means with said cam follower and actuating said sheet discharge means to discharge said sheet of paper when said detecting means detects that said sheet of paper is improper, wherein said detecting means comprises a first detecting unit disposed in a first marginal position of said sheet of paper and a second detecting unit disposed in a second marginal position thereof, a line connecting said first and second marginal positions being substantially perpendicular to a sheet supplying direction of said proper sheet of paper, said first and second detecting units outputting first and second sheet presence signals, respectively, when said sheet of paper is detected, and wherein when said first and second sheet presence signals are outputted at different times, said detecting means decides said sheet of paper passing therethrough as being diagonally oriented and thus improper.

8. A sheet feeder according to claim 7, wherein said first detecting unit comprises a first light emitting element for emitting a light and a first light receiving element disposed in spaced apart relation with said first light emitting element to receive said light emitted from said first light emitting element, and said second detecting unit comprises a second light emitting element for emitting a light and a second light receiving element disposed in spaced apart relation with said second light emitting element to receive said light emitted from said second light emitting element.

9. A sheet feeder according to claim 8, wherein said sheet discharge means comprises a sheet discharge roller for conveying said sheet of paper while being in surface contact with said paper supply cylinder, and a stripper disposed movably toward said paper supply cylinder for stripping said sheet of paper from said paper supply cylinder.

10. A sheet feeder according to claim 7, wherein said first detecting unit comprises a first magnetic flux producing unit for producing a magnetic flux and a first magnetic flux sensing unit disposed in spaced apart relation with said first magnetic flux producing unit to sense said magnetic flux from said first magnetic flux producing element, and said second detecting unit comprises a second magnetic flux producing unit for producing a magnetic flux and a second magnetic flux sensing unit disposed in spaced apart relation with said second magnetic flux producing unit to sense said magnetic flux from said second magnetic flux producing element.

11. A sheet feeder according to claim 10, wherein said sheet discharge means comprises a sheet discharge roller for conveying said sheet of paper while being in surface contact with said paper supply cylinder, and a stripper disposed movably toward said paper supply cylinder for stripping said sheet of paper from said paper supply cylinder.

12. A sheet feeder in a sheet-fed printing press comprising:

a pair of frames provided in spaced apart relation with each other;

a paper supply cylinder rotatably supported between said pair of frames for supplying a sheet of paper into said sheet-fed printing press, said paper supply cylinder having a gripper shaft;

a gripper mounted on said gripper shaft, said gripper being selectively held in a closed state at a first position adapted to grip said sheet of paper between said paper supply cylinder and said gripper and in an open state at a second position adapted to release said sheet of paper gripped therebetween as said paper supply cylinder rotates;

a detecting means disposed adjacent to said paper supply cylinder for detecting if said sheet of paper as supplied is proper or improper for performing a printing in said sheet-fed printing press;

a cam follower fixedly provided on said gripper shaft, said cam follower moving along a path as said gripper shaft rotates;

a gripper opening means disposed to be abuttable with said cam follower for causing said gripper to assume said open state;

a sheet discharge means disposed at a third position between the first and second positions for discharging said sheet of paper released when said gripper is in said open state; and actuator means connected to said detecting means for abutting said gripper opening means with said cam follower and actuating said sheet discharge means to discharge said sheet of paper when said detecting means detects that said sheet of paper is improper.

13. A sheet feeder according to claim 12, wherein said detecting means comprises a light emitting element for emitting a light and a light receiving element disposed in spaced apart relation with said light emitting element to receive said light emitted from said light emittime element, said sheet of paper being passed through the space between said light emitting and light receiving elements, and wherein when an amount of light received at said light receiving element changes from an amount of light received thereat as said proper sheet of paper passes through said space, said detecting means decides said sheet of paper passing therethrough as being improper.

14. A sheet feeder according to claim 12, wherein said sheet discharge means comprises a roller shaft (28) rotatably supported between said pair of frames, a sheet discharge roller (17) rotatably supported on said roller shaft (28) for conveying said sheet of paper while being in surface contact with said paper supply cylinder, a stripper shaft (34) rotatably supported between said pair of frames, and a stripper (18) fixedly mounted on said stripper shaft (34) and disposed movably toward said paper supply cylinder for stripping said sheet of paper from said paper supply cylinder.

15. A sheet feeder according to claim 14, wherein said paper supply cylinder is a paper feed cylinder provided in a monochromatic sheet-fed printing press having an impression cylinder and said paper feed cylinder.

16. A sheet feeder according to claim 14, wherein said paper supply cylinder is a paper feed cylinder provided in a multichromatic sheet-fed printing press having a plurality of printing units in succession, and said paper feed cylinder being provided between adjacent two printing units of said plurality of printing units.

17. A sheet feeder according to claim 12, wherein said detecting means comprises a magnetic flux producing unit for producing a magnetic flux and a magnetic flux sensing unit disposed in spaced apart relation with said magnetic flux producing unit to sense said magnetic flux from said magnetic flux producing element, said sheet of paper being passed through the space between said magnetic flux producing unit and said magnetic flux sensing unit, and wherein when an amount of magnetic flux sensed in said magnetic flux sensing unit changes from an amount of magnetic flux sensed therein as said proper sheet of paper passes through said space, said detecting means decides said sheet of paper passing therethrough as being improper.

18. A sheet feeder according to claim 17, wherein said sheet discharge means comprises a sheet discharge roller for conveying said sheet of paper while being in surface contact with said paper supply cylinder, and a stripper disposed movably toward said paper supply cylinder for stripping said sheet of paper from said paper supply cylinder.

19. A sheet feeder according to claim 12, wherein said detecting means comprises a first detecting unit disposed in a first marginal position of said sheet of paper and a second detecting unit disposed in a second marginal position thereof, a line connecting said first and second marginal positions being substantially perpendicular to a sheet supplying direction of said proper sheet of paper, said first and second detecting units outputting first and second sheet presence signals, respectively, when said sheet of paper is detected, and wherein when said first and second sheet presence signals are outputted at different times, said detecting means decides said sheet of paper passing therethrough as being diagonally oriented and thus improper.

20. A sheet feeder according to claim 19, wherein said first detecting unit comprises a first light emitting element for emitting a light and a first light receiving element disposed in spaced apart relation with said first light emitting element to receive said light emitted from said first light emitting element, and said second detecting unit comprises a second light emitting element for emitting a light and a second light receiving element disposed in spaced apart relation with said second light emitting element to receive said light emitted from said second light emitting element.

21. A sheet feeder according to claim 20, wherein said sheet discharge means comprises a sheet discharge roller for conveying said sheet of paper while being in surface contact with said paper supply cylinder, and a stripper disposed movably toward said paper supply cylinder for stripping said sheet of paper from said paper supply cylinder.

22. A sheet feeder according to claim 19, wherein said first detecting unit comprises a first magnetic flux producing unit for producing a magnetic flux and a first magnetic flux sensing unit disposed in spaced apart relation with said first magnetic flux producing unit to sense said magnetic flux from said first magnetic flux producing element, and said second detecting unit comprises a second magnetic flux producing unit for producing a magnetic flux and a second magnetic flux sensing unit disposed in spaced apart relation with said second magnetic flux producing unit to sense said magnetic flux from said second magnetic flux producing element.

23. A sheet feeder according to claim 22, wherein said sheet discharge means comprises a sheet discharge roller for conveying said sheet of paper while being in surface contact with said paper supply cylinder, and a stripper disposed movably toward said paper supply cylinder for stripping said sheet of paper from said paper supply cylinder.

24. A sheet feeder according to claim 14, wherein said gripper opening means is disposed between the first and third positions.

25. A sheet feeder according to claim 24, wherein said gripper opening means comprises a lever operatively connected to said actuating means, and a pin engaged with said lever, said pin projecting into and retracting out of the path of said cam follower.

26. A sheet feeder according to claim 25, further comprising link means for connecting said actuating means, said roller shaft (28), and said stripper shaft (34).

* * * * *